US005084937A

United States Patent [19]

Hague

[11] Patent Number: 5,084,937

[45] Date of Patent: Feb. 4, 1992

[54] ERASER CRUMB CLEANER

[76] Inventor: Ekramul Hague, 1300 Frontier La., Manhattan, Kans. 66502

[21] Appl. No.: 652,989

[22] Filed: Feb. 8, 1991

[51] Int. Cl.[5] ..... A47L 5/24

[52] U.S. Cl. ..... 15/3.53; 15/344; 15/353

[58] Field of Search ..... 15/3.53, 301, 344, 353

[56] References Cited

U.S. PATENT DOCUMENTS

| | | | |
|---|---|---|---|
| 2,956,546 | 10/1960 | Teters et al. | 15/3.53 |
| 3,548,436 | 12/1970 | Henrich | 15/339 X |
| 3,774,255 | 11/1973 | Pao | 15/344 X |
| 3,903,564 | 9/1975 | Morinaga | 15/344 |
| 3,934,302 | 1/1976 | Mabuchi | 15/344 X |
| 4,018,238 | 5/1977 | Nelle | 15/314 |
| 4,042,999 | 8/1977 | Triantafyllou | 15/344 X |
| 4,172,710 | 10/1980 | Van der Molen | 15/353 X |
| 4,268,288 | 5/1981 | Coombs | 15/353 X |

*Primary Examiner*—Chris K. Moore

[57] ABSTRACT

An eraser crumb cleaner held in hand like a writing pen for collecting eraser crumbs and the like simultaneously while erasing, consisting of an eraser holder; a suction pipe to suck and transport the crumbs from the collection points to the removable container; a baffle within the container to reduce the momentum of the eraser crumbs and to force them to settle; an inlet pipe to conveniently support the apparatus of this invention on hand and direct air to the inlet of a backwardly curved-vane centrifugal fan; an enclosure for the centrifugal fan to provide an appropriate outlet area for the sucked air; an electric motor to run the centrifugal fan; a power means; and a switching means. The suction produced by the centrifugal fan forces and transports the eraser crumbs through the suction pipe to the baffle where the crumbs are deflected, lose momentum, and are forced to settle in the removable container for final disposal.

1 Claim, 3 Drawing Sheets

ERASER CRUMB CLEANER

BACKGROUND OF THE INVENTION

1. Field of the Invention

This invention relates to an apparatus for removing, and collecting nuisance particulates larger than the size of household dusts from work tables and other small areas. More particularly, the present invention is concerned with a mechanized apparatus held in hand like a writing pen and used for removing crumbs of pencil erasers that originate on a paper during erasing process, and collecting the crumbs in a container for final disposal. This invention further relates to an apparatus for erasing, brushing to loosen the eraser crumbs that stick to the paper surface, and collecting the crumbs in a container for final disposal.

Eraser crumbs are nuisance particulates that pervade drafting areas used by draftsmen, engineers, artists, and students who use electric erasers frequently. Electric erasing process generate crumbs that make the papers, tables, floors, and other places dirty.

2. Description of Prior Art

Appropriate mechanized apparatus for cleaning eraser crumbs simultaneously while erasing has not yet been developed. Existing process of cleaning the eraser crumbs consists of whisking them away or manually collecting them in various containers by using brushes before final disposal. Both solutions are far from desirable but they are the only practical and workable methods available at present. In the events when the crumbs are brushed away, they usually fall on the floors making the floors dirty. In case of thickly carpeted floors, the crumbs could penetrate deep into the carpets making it difficult for the vacuum cleaners to pick them up. Eraser crumbs make an ugly sight, a dirty, and unhealthy living and working conditions.

What is needed is to design a convenient mechanized apparatus that is held in hand like a writing pen and allows to 1) erase manually, 2) brush to loosen the eraser crumbs if and when they stick to the paper surface, 3) vacuum clean the crumbs as soon as formed and 4) collect the crumbs for final disposal in a removable container integral to the apparatus. A desirable apparatus should have a power requirement like a small powered toy; and an easily detachable crumb container.

SUMMARY OF THE INVENTION

The problems outlined above are in large measures solved by "Eraser Crumb Cleaner" in accordance with the present invention. That is to say, the apparatus serves a very useful function; is of appropriate design, and convenience; and requires only household DC cells as a power source to operate. It could be used by almost everybody in the world who writes and erases including beginning writers such as elementary school children. This invention could have values to young children both as an educational model, and as a toy.

The apparatus in accordance with the present invention which is held in hand like a writing pen broadly includes an eraser holder that holds an eraser; a small suction pipe like the size of a pencil so as to suck and transport the eraser crumbs into a detachable container; the said container with a baffle so as to reduce the momentum of the crumbs and force them to settle in the said container; a backwardly curved-vane centrifugal fan about the diameter of a quarter coin to cause suction of the eraser crumbs; an inlet pipe so as to conveniently support the apparatus of this invention on hand and direct air to the fan inlet; an enclosure for the fan to provide an appropriate air-outlet area; a small DC motor to run the fan; a brush to loosen the eraser crumbs if and when necessary; a switch to put the apparatus on or off; and a battery box to house the power source.

DETAILED DESCRIPTION OF THE INVENTION

Figure 1:
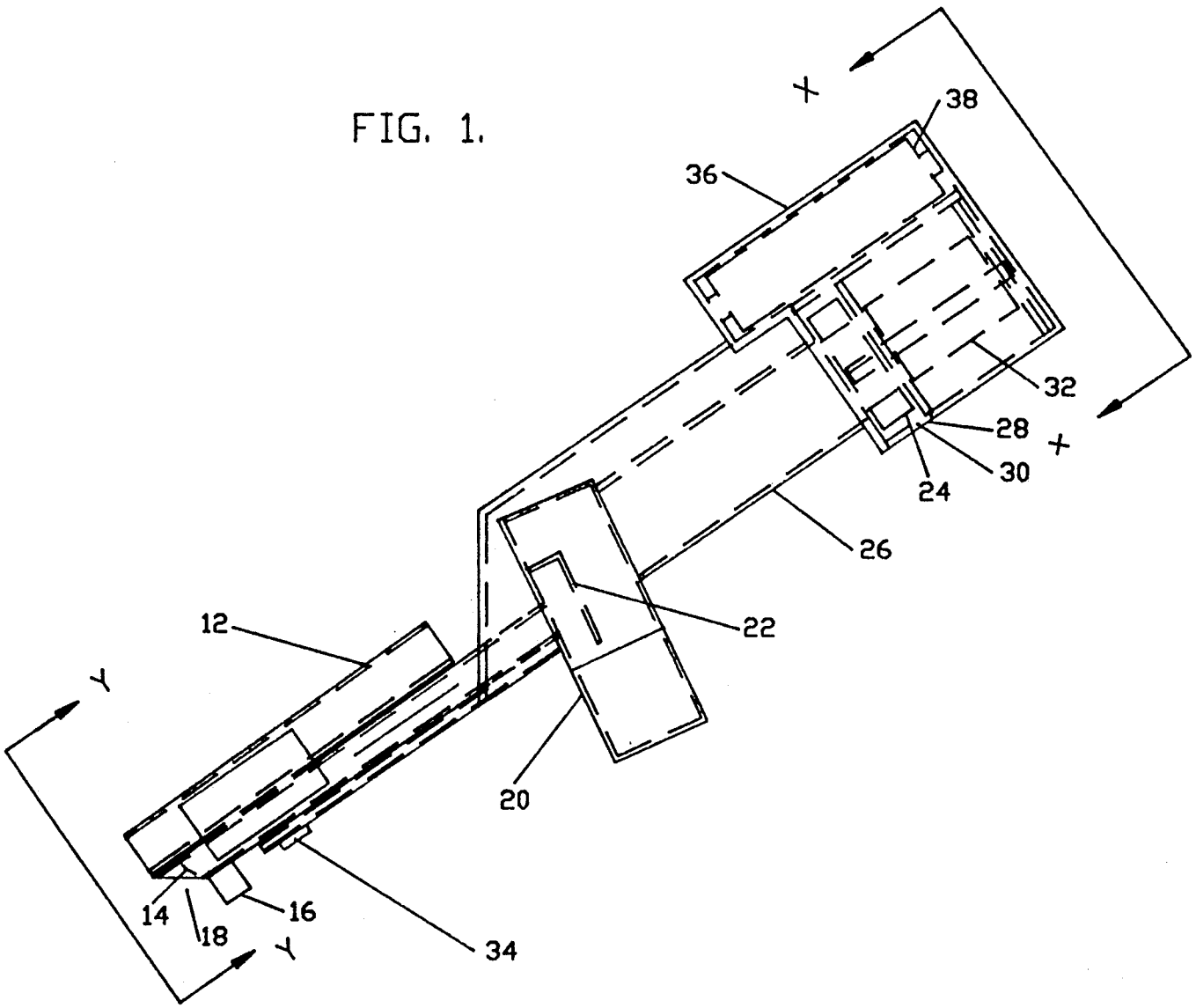
FIG. 1 is a front elevational view of the apparatus.
Figure 2:
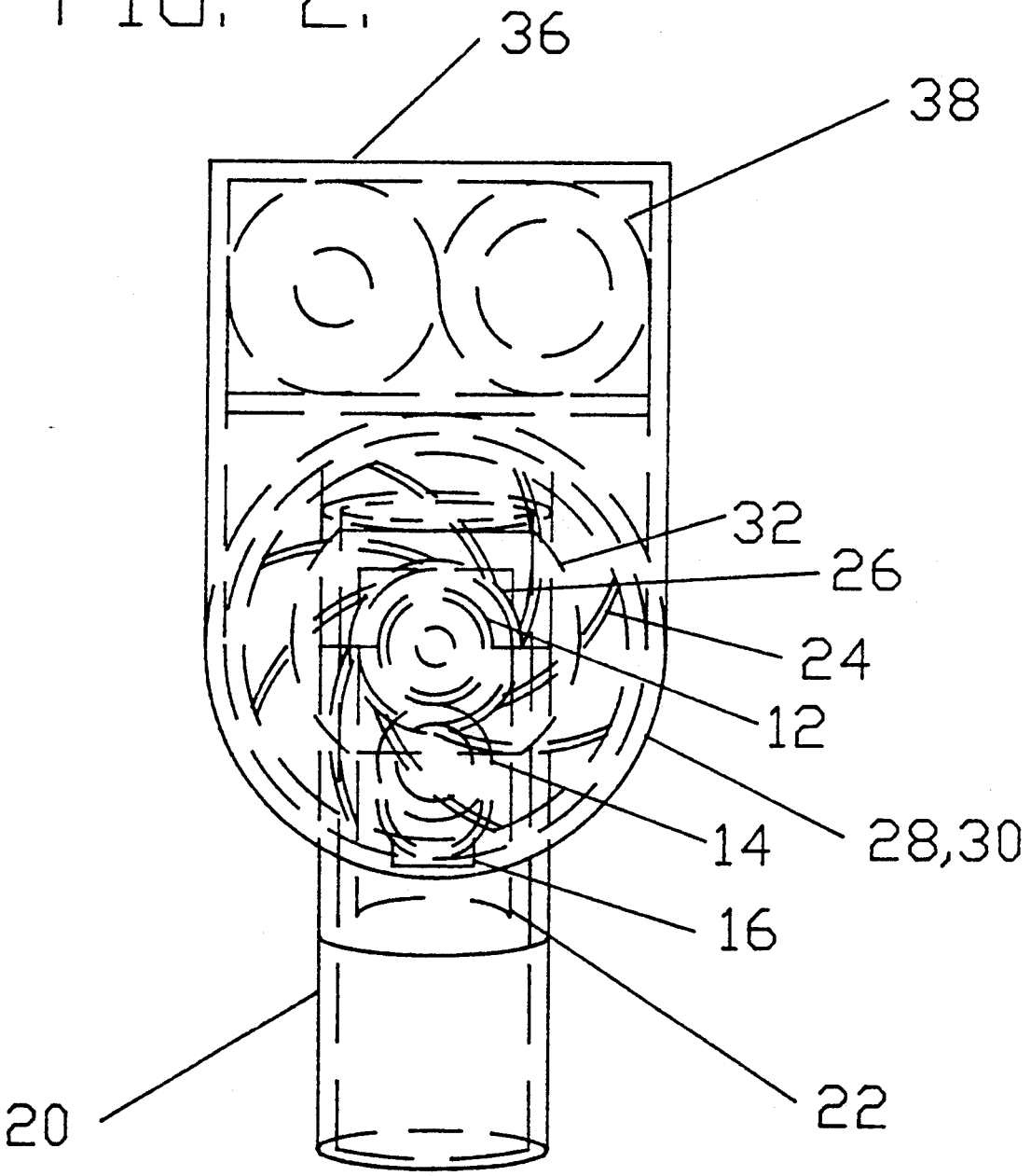
FIG. 2 is a right view of the apparatus as viewed from the direction x—x as shown in FIG. 1.
Figure 3:
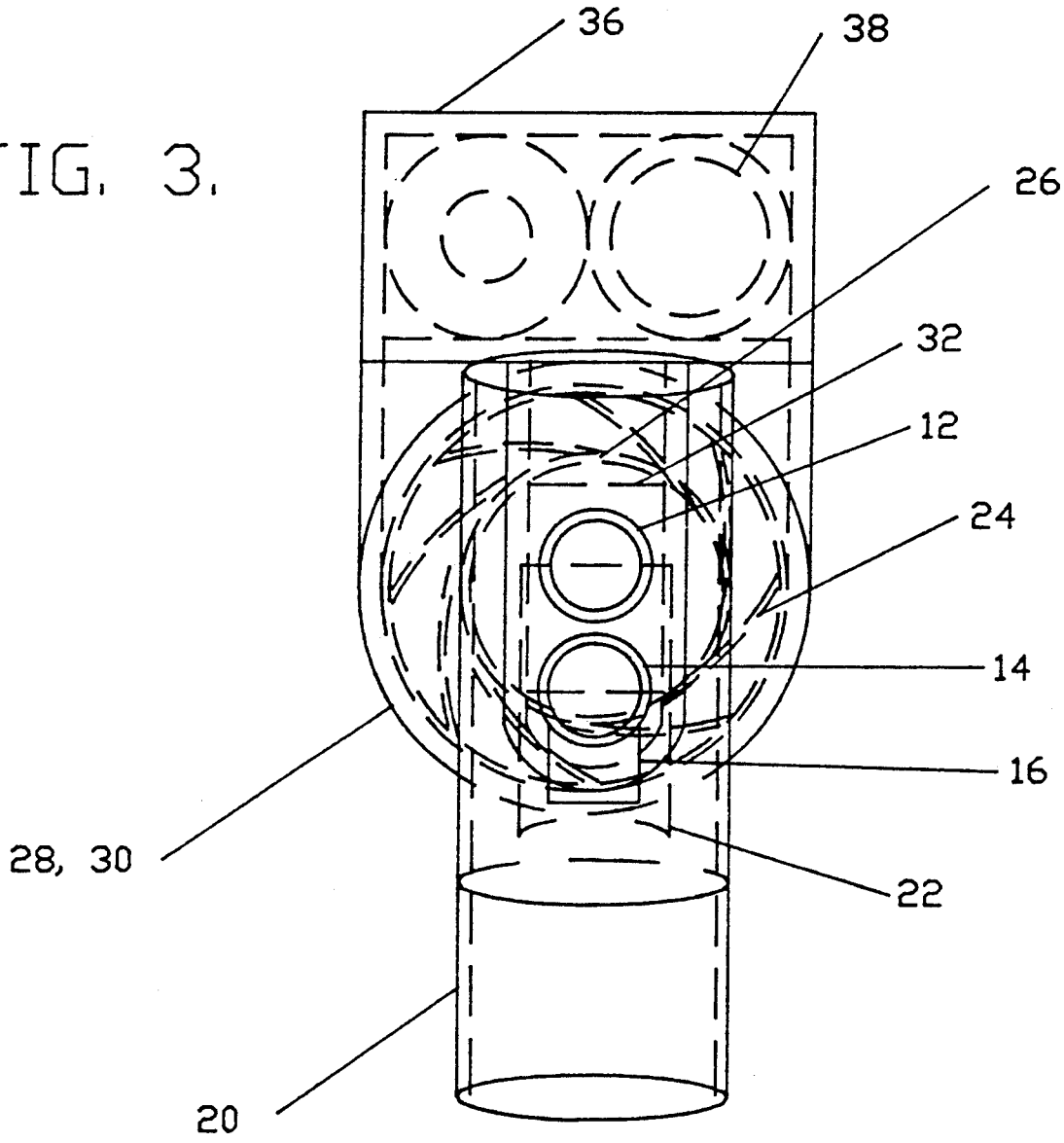
FIG. 3 is a left view of the apparatus as viewed from the direction y—y as shown in FIG. 1.

Referring now to the drawings in FIG. 1, FIG. 2, and FIG. 3; eraser crumb cleaner; in accordance with this invention broadly includes an eraser holder 12; a suction pipe 14; a brush 16; the suction pipe nozzle opening 18; a container 20, and a baffle within the container 22; a backwardly curved-vane centrifugal fan 24; an inlet pipe 26, so as to conveniently support the apparatus of this invention on hand and direct air to the fan; an enclosure 28, surrounding the fan to provide appropriate outlet openings 30; a DC motor 32; an on-off switch 34; and a battery compartment 36. When the switch 34, of the apparatus is put "on" the motor 32, is energized; the centrifugal fan 24, rotates at a high speed and creates a suction through the apparatus. The eraser crumbs that are formed during erasing are introduced through the nozzle opening 18, into the suction pipe 14, and pneumatically transported into the container 20, where they impinge on the baffle 22. Due to the impingement the crumbs lose their momentum and settle in the container 20, while the clean air passes through the inlet pipe 26, into the centrifugal fan 24, and finally out of the apparatus through the outlet openings 30. The power to the DC motor 32, is supplied by 2 DC cells 38, located in the battery compartment 36, each cell having a rating of 1.5 volts.

I claim:

1. An eraser crumb cleaner held in the hand like a writing pen for collecting eraser crumbs and the like, simultaneously while erasing on paper comprising:

an eraser holder of a hollow cylindrical shape;

a suction pipe of a cylindrical shape and of a first inner diameter, said suction pipe being open at both ends and having an axis inclined to the plane of the paper, one end of said suction pipe serving as nozzle opening and a first receiving point of the eraser crumbs, said suction pipe and said eraser holder being fused together like two barrels of a double-barrel gun with said suction pipe positioned under said eraser holder;

a cleaning brush;

a container of a cylindrical shape and of a second inner diameter, said container having an axis substantially perpendicular to the plane of the paper and positioned within the space formed by the palm of the hand holding the eraser crumb cleaner, the other end of said suction pipe penetrating radially into said container;

a baffle fixed integrally into the inside of said container, said baffle being positioned facing said suction pipe;

an inlet pipe of a third inner diameter so as to conveniently support the apparatus of this invention on the hand holding the apparatus and rest comfortably on the metacarpal bone area of the index finger adjacent to the thumb, said inlet pipe being substantially equal in diameter to said container, said inlet pipe having substantially equal inclination to the plane of the paper as said suction pipe, the bottoms of said suction pipe and said inlet pipe forming one straight line, the lower end of said inlet pipe penetrating radially into said container;

a centrifugal fan having a fan rotor of a fourth diameter and of a backwardly curved-vane type positioned concentrically to said inlet pipe at the upper end of said inlet pipe;

an enclosure for said centrifugal fan to provide an appropriate air-outlet area, said enclosure having a cylindrical shape and surrounding said fan rotor, said enclosure being of a fifth inner diameter marginally larger than the fourth diameter and providing sufficient clearance between said enclosure and said fan rotor, said enclosure being positioned with its axis in line with the axis of said fan rotor, said enclosure having equidistant slot openings around its periphery for the passage of the air out of the apparatus of this invention, said slot openings being in line with the fan rotor;

an electric motor with its axis positioned colinear with the axis of said fan rotor;

a power means for supplying power to the electric motor and a switching means for turning the electric motor on or off.

* * * * *

UNITED STATES PATENT AND TRADEMARK OFFICE

CERTIFICATE OF CORRECTION

PATENT NO. : 5,084,937

DATED : 02/04/1992

INVENTOR(S) : Haque

It is certified that error appears in the above-identified patent and that said Letters Patent is hereby corrected as shown below:

On the title page, Items [19] and [76] should read

--Ekramul Haque--.

Signed and Sealed this

Eleventh Day of August, 1992

*Attest:*

DOUGLAS B. COMER

*Attesting Officer*

*Acting Commissioner of Patents and Trademarks*